US005748055A

United States Patent [19]

Ors

[11] Patent Number: 5,748,055

[45] Date of Patent: May 5, 1998

[54] MICROWAVE SWITCH

[75] Inventor: Göran Ors, Pärlröksgången, Sweden

[73] Assignee: Sivers Lab Aktiebolag, Kista, Sweden

[21] Appl. No.: 765,722

[22] PCT Filed: Jun. 27, 1995

[86] PCT No.: PCT/SE95/00722

§ 371 Date: Dec. 30, 1996

§ 102(e) Date: Dec. 30, 1996

[87] PCT Pub. No.: WO96/00988

PCT Pub. Date: Jan. 11, 1996

[30] Foreign Application Priority Data

Jun. 29, 1994 [SE] Sweden ..... 9402308

[51] Int. Cl.[6] ..... H01B 1/10; H01B 5/12

[52] U.S. Cl. ..... 333/106; 335/4

[58] Field of Search ..... 333/106, 108; 335/4, 5, 125, 230, 253

[56] References Cited

U.S. PATENT DOCUMENTS

| | | | |
|---|---|---|---|
| 3,694,782 | 9/1972 | Ray | 335/230 |
| 3,761,851 | 9/1973 | Nelson | 335/253 |
| 4,227,164 | 10/1980 | Kitahara | 335/230 |
| 4,500,861 | 2/1985 | Nelson | 335/253 |
| 4,520,331 | 5/1985 | Steidel | 335/125 |
| 4,546,338 | 10/1985 | Idogaki et al. | 335/229 |
| 4,633,201 | 12/1986 | Ruff | 333/106 |
| 4,665,373 | 5/1987 | Merlo | 333/106 |
| 4,795,929 | 1/1989 | Elgass | 310/36 |
| 5,268,660 | 12/1993 | Cappelli | 335/4 |
| 5,499,006 | 3/1996 | Engel et al. | 335/4 |

FOREIGN PATENT DOCUMENTS

| | | |
|---|---|---|
| 653036 | 5/1991 | U.S.S.R. . |
| 707659 | 1/1992 | U.S.S.R. . |
| 029646 | 3/1980 | United Kingdom . |

*Primary Examiner*—Paul Gensler
*Attorney, Agent, or Firm*—Christie, Parker & Hale, LLP

[57] ABSTRACT

The invention is directed to a microwave switch comprising a switch housing having side walls in which wave guide terminals are provided, and a switch rotor carried by a shaft which is mounted in bearings in said switch housing and being rotatable between switch positions defined by stop means limiting the rotation of said switch rotor a maximum of 180°, and an electromagnetic driving device having a permanent magnetic rotor part fixed directly onto the shaft of the switch rotor and having diametrically positioned magnetic poles of opposite polarities, and a stator part having an electric driving coil arranged on a magnetic yoke which is connected with two poles shoes, said stop means comprising a stop element on said switch rotor and impact elements provided in said switch housing.

10 Claims, 3 Drawing Sheets

MICROWAVE SWITCH

BACKGROUND OF THE INVENTION

One frequent design in prior art microwave switches is such that the microwave function in itself, that is mainly the switch housing and the switch rotor and the driving function, that is said electromagnetic driving device or corresponding means for rotating the switch rotor, are built in the form of substantially separate units. Generally, these driving devices comprises a magnetic rotor element which is surrounded by at least one electromagnetic stator element, being each optionally provided with one or several driving coils generating a magnetic field for driving the rotor element. Such designs are disclosed in U.S. Pat. Nos. 3,694,782, 4,227,164, 3,761,851 and 4,500,861. In order to obtain a reduced switching time strong electromagnets are frequently used requiring a high electrical power and having a big soft iron mass. Frequently used are also arrangements of several electromagnets being activated simultaneously for generating a stronger magnetic field. As a consequence the driving devices are characterized by a complicated design including several mechanical and electrical elements, high weight and a comparatively large volume, being thereby space demanding in the actual applications.

The rotary movement of the driving device may be transferred to the switch rotor in different ways. For example, U.S. Pat. No. 4,795,929 discloses a construction using an arm 50 (FIG. 4) which is attached onto the shaft 20 of the driving device. The movement of said shaft in its turn is transferred to the microwave switch rotor by a type of mechanical gear, which may comprise so called "Maltese cross" by which said arm is mechanically connected with the switch rotor. The construction provides for damping of the rotor movement at the switch positions. Alternative examples of a movement transmission between the driving device and the switch rotor are found in U.S. Pat. No. 4,520,331.

The comparatively complicated structure of these prior art driving devices at the same time ends up in high manufacturing costs for the complete microwave switch. Furthermore the prior art constructions comprise a number of wear suffering detail elements, for example said mechanical gear, said stop means for defining the switch positions and mechanically controlled switches for the current supply to the driving coils, all together reducing the useful life time of the microwave switch and causing maintenance costs.

The tendency of a rebounding action between said stop means at the switch positions is a general problem in microwave switches of the type in question. The problem is enhanced by the fact that a fast switch action is demanded at the same time by the switch rotor between the switch positions. The impact energy at the switch positions will also cause mechanical wear of the stop means.

In U.S. Pat. No. 4,665,373 is disclosed a microwave switch, which, for solving the problem with said rebounding action, has been provided with a rotatable metal disc of substantially the same weight as the switch rotor. Immediately before the switch position is reached by the switch rotor an impact takes place between corresponding pins on said rotatable disc and one the switch rotor, thereby transferring the kinetic energy to said disc. As such this design is relatively complicated because the rotor is mounted in bearings in the switch housing, being space demanding as well. By the mode of operation it is required that the moveable disc in its turn must be stopped and brought to a defined start position before a nextcoming switch movement.

OBJECTS OF THE INVENTION

The object of the invention is to provide a microwave switch of the type mentioned in the introduction and not having the mentioned drawbacks of prior art, allowing for damping of the switch rotor movement at the switch positions by simple measures, and allowing for a compactly built switch of low weight.

One further object of invention is to use a low number of moving parts, demanding a minimal amount of maintenance, and to provide a switch design facilitating correct balancing of component parts and being therefore suitable for use in environments exposed to vibrations, for example in airplanes.

The object of invention is obtained by a microwave switch of the type mentioned in the introduction, which is characterized by said stop means comprising a shock absorbing disc resiliently arranged in said switch housing, said disc comprising in one unit said impact elements, defining together with said stop element the angle of rotation of the switch rotor, and said impact elements and said disc being symmetrically arranged in relation to said shaft, said disc performing thereby a damping movement in different directions at the impact of said stop element against said respective impact elements. By said resilient arrangement of the disc a shock absorbing function is obtained which provides for a rapid and effective damping of the switch rotor movement and reducing at the same time the load on said stop and impact elements.

According to the invention said resiliency may preferably be obtained in two different ways, that is on one hand according to a first embodiment in which said disc is attached to the switch housing by means of a layer of an elastic material, and on the second hand by a second embodiment in which said disc has a frictional engagement with the switch housing and may be displaced between two positions.

In order to save space and weight the driving device of the microwave switch according to the invention comprises one driving coil. When switching the switch device the driving current through the coil is reversed by means of an electronic control circuit. According to one preferred embodiment of the microwave switch according to the invention said electronic control circuit comprises a time function maintaining the switching current during an elapse of time which is longer than the time of movement of the switch rotor between the switch positions. Thereby is generated, during a given tie interval after the impact time, a holding force participating to an improved shock absorbing action of the disc. The advantage of a purely time based control of this type is that the time function may be integrated in to the electronic control circuit by means of simple programming measures without significant costs. Another advantage of the purely time based control of the switching current is the security of current switching, eliminating the risk of overheating the driving coil of the driving device.

SU 1653036-A (Maksimov A I) discloses a microwave switch in which a delayed interruption of the switching current is obtained by electromechanical means. The delay is based on the movement of the switch rotor and means that the movement of a so called "dog" is continued a given time after impact of the switch rotor. The mechanical construction is fairly complicated and space demanding. At a malfunction the current is not interrupted with a consequent risk of driving device damages.

Further features of the microwave switch according to the invention are evident from the succeeding claims.

BRIEF DESCRIPTION OF THE DRAWINGS

The invention will be described more closely in the following in connection with a non-limitative embodiment by reference to the drawings, in which.

DETAILED DESCRIPTION OF THE INVENTION

Figure 1:
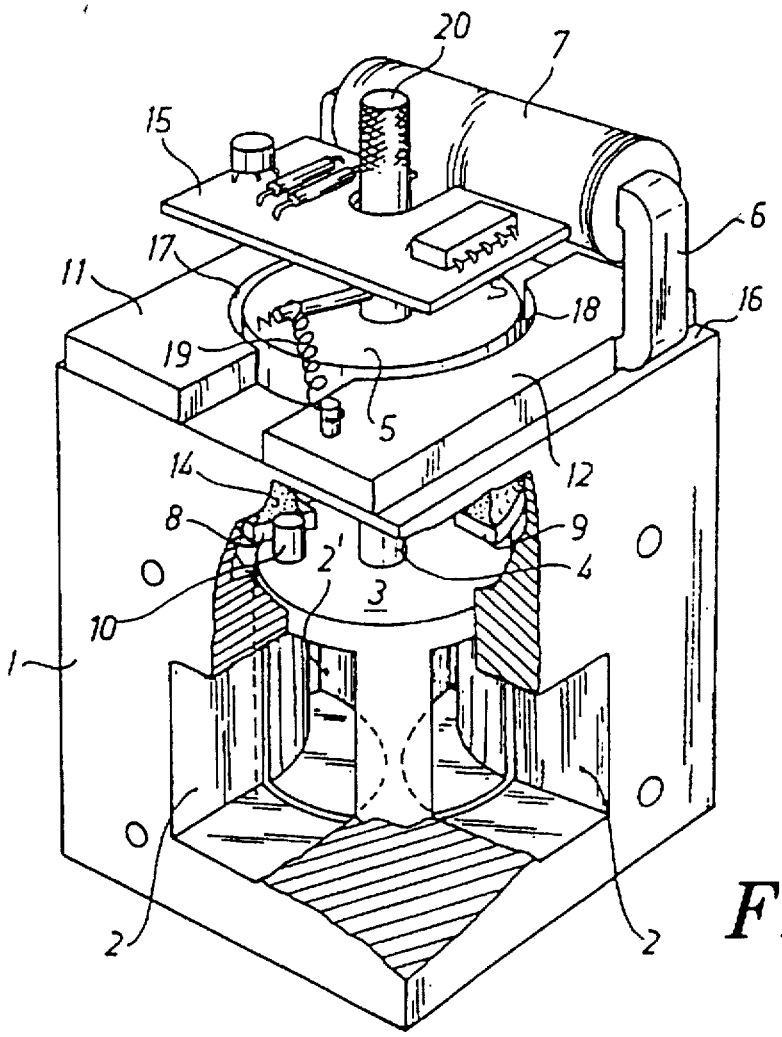
FIG. 1 discloses a partly broken up perspective view of a microwave switch according to the invention, FIG. 2 discloses a block diagram showing the structure of the microwave switch electronic circuit, FIG. 3 discloses a detailed view of the attachment of the shock absorbing disc, FIG. 4 discloses FIG. 3 in an elevational view of the switch device housing with the roof wall thereof eliminated, and FIG. 5 discloses an alternative embodiment of the shocking absorbing disc according to the invention.

The microwave switch as shown in FIG. 1 comprises a switch housing 1 having waveguide terminals 2 to which rectangular waveguides may be connected in the embodiment, as shown. A switch rotor 3 is rotatably mounted on a shaft 4, said rotor being provided with usual ports 2' through which said terminals 2 may be interconnected dependent on the angular position of the switch rotor. The shaft 4 is mounted on bearings at its upper and lower ends at the roof and the bottom of the switch housing, respectively, in a professional manner, for example by means of a ballbearing below rotor 3 at the bottom of the cavity and a ballbearing 21 provided on the upper side of the cavity roof as disclosed in FIG. 3.

The electromagnetic driving device of the microwave switch is integrated with the upper part of the switch housing. The permanent magnetic rotor part of the driving device has the shape of a circular rotor disc 5 having diametrically positioned magnetical poles N, S of opposite polarity. The center of said disc is fixed directly onto the switch rotor shaft 4.

The stator part of the driving device comprises a magnetic yoke 6 having the shape of an upside down U on which a driving coil 7 is provided. The legs of the magnetic yoke transform into a respective disc shaped pole shoe 11 and 12, being arranged in plane with the roof of the switch housing. In the disclosed embodiment the magnetic yoke and pole shoes are manufactured in one piece of a bent, soft magnetical sheet metal, and consequently the magnetic yoke and the pole shoes have one and the same thickness. This design of the magnetic yoke and the pole shoes facilitates manufacturing and reduces costs therefor and at the same time simplifies mounting on the switch housing.

The poles 11, 12 are provided wit ha respective circle-segment shaped recess 17, 18, having a shape which adjoins to the circumference of the circular rotor with an airgap therebetween.

An electronic control circuit 15 is provided for supplying a switching current to the driving coil of reversible current direction. The consequence of a reversible current direction is that one driving coil 7 may be used having a single winding instead of two windings according to common prior art. At the same time the driving device may be controlled by means of the same set of control signals that are used in traditional designs having two separate windings. This facilitates use of the microwave switch as a replacement part in existing microwave systems.

The use of one winding means that the full coil space may be used for this single winding, allowing thereby a 50% reduction of the driving current and the power consumption in consequence. Alternatively, the volume and weight of the driving coil may be reduced.

The switch rotor 3 has two switch positions in the disclosed embodiment, being defined by stop means comprising partly impact elements 8, 9 arranged on the ceiling of the switch housing 16 by means of an elastic layer 14, and partly a pin element 10 which is provided on the upper side of switch rotor. The detailed design of the impact elements 8, 9 will be described in the following by reference to FIG. 3 and FIG. 4.

Said pin 10 and the impact elements 8, 9 provide a limitation of the switch rotor rotation angle to a maximum of 180°. In this embodiment the angle of rotation is approximately 90° as is evident from FIG. 4.

The magnetic poles of the rotor disc 5 are arranged with an angular position in relation to the rotor switch positions, with said pin 10 engaging the impact element 8 or the impact element 9, which is such that the north pole N and the south pole S, respectively, of the disc is positioned substantially at the one or the other end of a respective circle-segment shaped recess 17 and 18. The magnetic force between the disc and pole shoes aims to turn said poles towards the respective centre of said circle segments. This magnetic force provides a holding force at the switch positions, keeping the switch rotor in place also without any current supply to the driving coil 7. The circle-segment shaped recesses of the pole shoes contribute to stabilization of the switch positions by increasing the magnetic force between the rotor disc and the pole shoes.

The switch rotor shaft 4 is provided with an extension 20 having a grip for allowing a manual switch-over of the switch rotor between the switch positions.

A return spring 19 is provided for returning the switch rotor 3 to the position in which the pin 10 engages the impact element 9 when the current supply to the coil 7 is interrupted. The spring 19 is fitted between an arm attached to the rotor shaft and a peg provided in the pole shoe 12. Alternatively, the switch rotor may be returned to said position by reversing the current through the driving coil.

Figure 2:
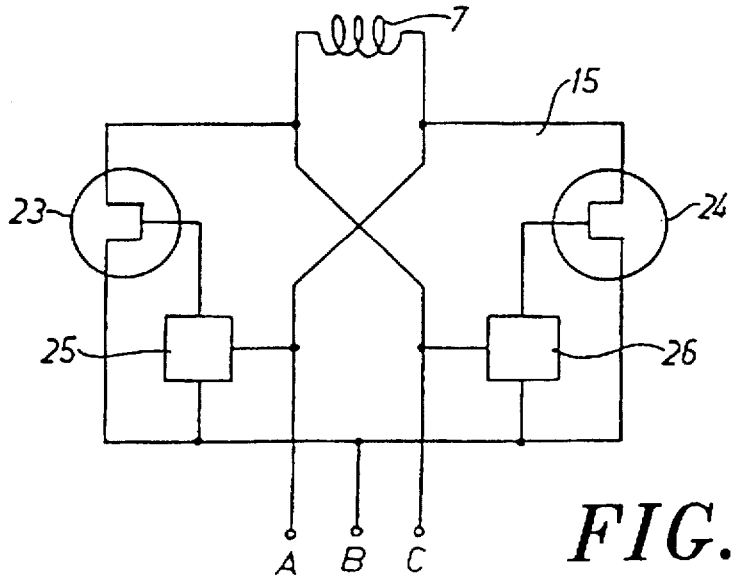

The block diagram in FIG. 2 discloses the general structure of the electronic control circuit 15. The circuit comprises two switch transistors 23, 24, the respective control inputs of which are connected to the output of timer circuits 25, 26, respectively. The circuit has three inputs A, B and C, the input B being common. These inputs correspond with the respective inputs of driving devices of a traditional type using two driving coils or windings. Dependent on a control voltage which is supplied between terminals A, B and C, B respectively, a driving current is generated in coil 7 in the one or the other direction through the coil 7.

The current supply is controlled by the switch transistors 23 and 24 dependent on the respective timer circuits 25 and 26 by an interruption of the feed-back conductor of the driving current at a change of state of the control signal from said respective timer circuits. The timer circuits 25, 26 are so dimensioned that the driving current through the coil is maintained during an elapse of time which is longer than the time of movement of the switch rotor 3 between the switch positions. For example, the circuits may comprise a clock controlled binary counter which counts down a preset time. Alternatively, the delayed interruption of the current through the coil may be obtained by a capacitor circuit of professional type.

The ability of the control circuit 15 of reversing the driving current direction and maintaining the same during said elapse of time are the functions which are substantial for the realization of the invention. Remaining constructional details of the control circuit are purely professional and will therefore not be thoroughly described in this context.

Figure 3:
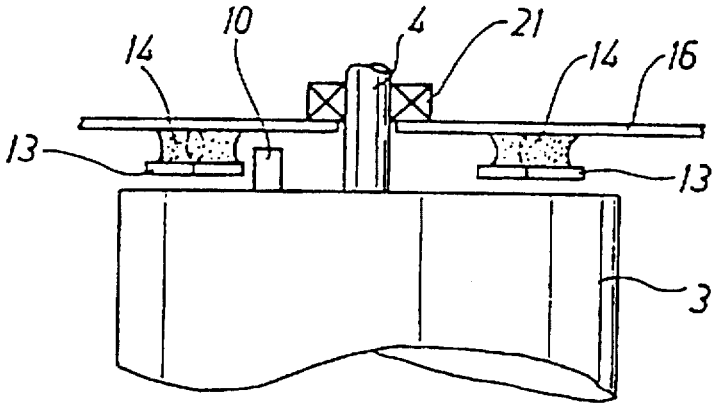
Figure 4:
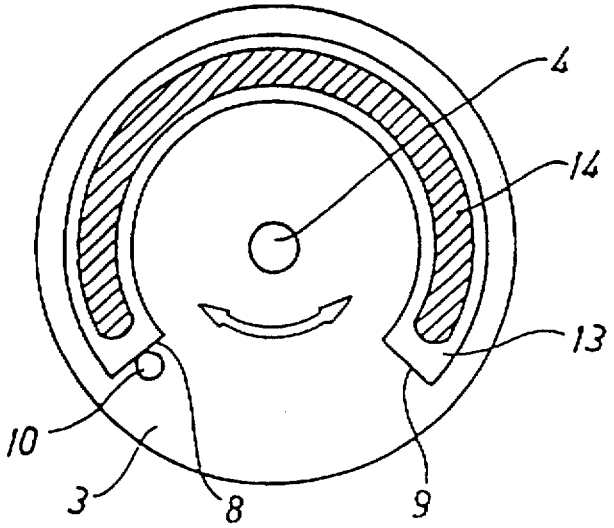

FIG. 3 and FIG. 4 disclose more in detail the arrangement of the stop means of the microwave switch. In this embodiment the impact elements 8, 9 are provided by the ends of a ring-shaped disc 13, being attached to the ceiling of the switch housing 16. The disc is attached by means of a layer 14 of a shock absorbing elastic material.

The ring-shape of the disc means a comparatively long shock absorbing length which plays a role for the shock absorbing ability of the disc. The mutual positions of the impact elements 8, 9 are determined by the shape of the disc, which facilitates mounting thereof and adjustment of the switching positions.

The disc has a minimum weight with respect to the mass of the switch rotor in order to provide a desirable shock absorption, and at the same time the stiffness of the elastic material is adapted to the weight of the switch rotor. This eliminates the risk of self-oscillations of the disc in environments exposed to vibrations and the risk that vibrations of the disc may have an influence on the switch rotor by giving the same an unstable position. When the microwave switch is used in more stable environments a disc of substantially the same weight as the switch rotor may be used adequately.

The microwave switch operates in the following manner. In the rest position the magnetic forces aim to rotate the poles of the rotor disc 5 towards the centre of the respective circle-segment shaped recesses 17, 19 of the pole shoes 11, 12. When a switching current is supplied to the coil 7 magnetic poles of different polarities are created in the pole shoes 11, 12. If the direction of the current is such that the polarity of the poles shoes corresponds wit the adjoining poles of the rotor disc 5 these poles will at first be repelled and rotate the rotor disc 5 towards the central position between the pole shoes and thereafter attract the rotor disc against the pole shoes and continuously rotate the switch rotor until the pin 10 engages the respective impact elements 8, 9. By this movement the switch rotor 3 is switched from a first to a second stable switch position. Thereafter the switching current is interrupted by the active one of the timer circuits 25 and 26. Switching to the other switch position is obtained correspondingly by reversing the direction of the switching current by changing the control signal to the terminals A, B, C of the control circuit.

Figure 5:
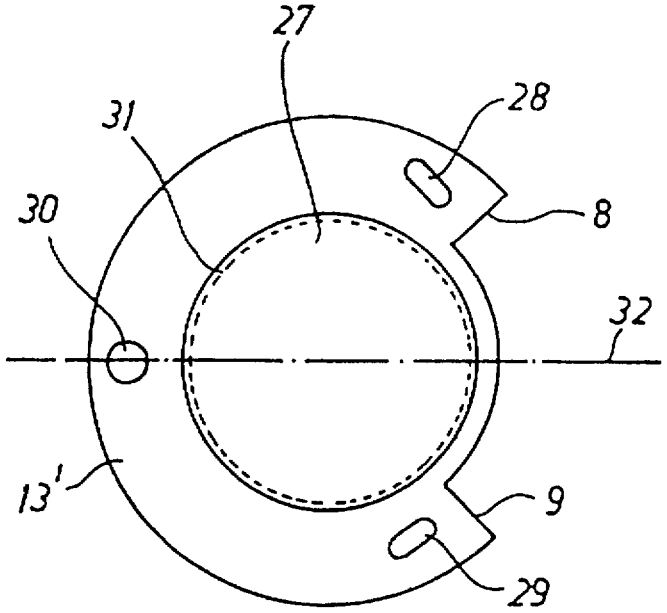

FIG. 5 discloses an alternative design 13' of the shock absorbing disc according the invention as seen from above. The disc is generally ring-shaped and has a central opening 27 and a peripherally arranged recess defining said two impact elements 8, 9 and thereby also the angle of rotation of the switch rotor. The disc is fitted for a central arrangement in relation to the shaft 4 and for attachment in a position in the switch housing in correspondence with what has been shown in FIG. 4. For the attachment in the switch housing the disc is provided with two elongated hoes 28, 29 by means of which the disc is fixed by means of two through-screw joints being preferably spring biased. The spring biasing is such that the disc will be held under pressure against the wall of the switch housing by a force which will provide a desirable friction between the disc and the wall. Optionally a specifically selected friction layer may be provided between the disc and the wall.

The elongated holes 28, 29 provide for the desirable resilience of the disc 13', being thereby movable between two positions defined by the lengths of the holes 28, 29 and said screw joints. When the pin element 10 on the switch rotor strikes the impact element 8 the disc 13' is moved from a first position to a second position, and when the pin element 10 strikes the impact element 9 at switching the switch rotor in the other direction the corresponding reverse movement of the disc 13' to its first position takes place. For the control of the movement of the disc a bearing pin 30 is provided along a line of symmetry 32 through said recess and the center of the rotor shaft. During said movement the disc is rotated around the bearing pin. Alternatively, the disc may be journalled along its internal periphery, for example by means of a guiding edge provided around the opening as has been indicated by the dotted circular line 31.

It is understood that the discs 13, 13' may as well be shaped differently maintaining the function thereof. Accordingly said recess for example may be arranged along the internal periphery of the ring-shape or be provided by means of a slot of a corresponding length.

Microwave switches of the actual type have normally two switch position. Of this reason the drawings and the description thereof illustrate an embodiment of this kind. However, it is evident that the switch according to the invention may have more than two switch positions, which may be obtained by the provision of adjustable stop means, for example electromechanically operable vertically adjustable impact elements 8, 9 of a professional type.

I claim:

1. A microwave switch comprising a switch housing having side walls in which wave guide terminals are provided and a switch rotor carried by a shaft which is mounted on bearings in said housing and being rotatable between switch positions defined by stop means limiting the rotation of the switch rotor to a maximum of 180°, and an electromagnetic driving device having a permanent magnetic rotor part fixed directly onto the shaft of the switch rotor and having diametrically positioned magnetic poles of opposite polarities, and a stator part comprising an electric driving coil arranged on a magnetic yoke connected with two poles shoes, said stop means comprising a stop element on said switch rotor and impact elements provided in said switch housing, characterized by said stop means comprising a shock absorbing disc being resiliently arranged in said switch housing and carrying in one single unit said impact elements defining in combination with said stop element the angle of rotation of the switch rotor, and said impact elements and said disc being symmetrically arranged in relation to said shaft, said disc performing thereby a damping movement changing directions at the impact of said stop element against said respective impact elements.

2. A microwave switch as claimed in claim 1, characterized by said shock absorbing disc being attached to the switch housing by means of a layer of an elastic material, and said elastic material layer having a stiffness which is adapted to the weight of the switch rotor so as to suppress rebounds at switching.

3. A microwave switch as claimed in claim 1 or 2, characterized by said disc having a comparatively low weight in relation to the switch rotor for suppressing tendencies of self-oscillation of the disc in environments exposed to vibrations.

4. A microwave switch as claimed in claim 1 or 2, characterized by the weight of said disc being adapted to the weight of the switch rotor for absorbing of shocks therefrom.

5. A microwave switch as claimed in claim 1 or 2, characterized by said disc being movably attached to the switch housing for a reciprocating movement between two positions at the impact of said stop element against said respective impact elements, and said disc frictionally engaging the switch housing.

6. A microwave switch as claimed in claim 1 or 2 characterized by said disc being provided with a recess forming said impact elements.

7. A microwave switch as claimed in claim 1 or 2 characterized by said shock absorbing disc being shaped as a ring, and the center of said ring coinciding with said switch rotor shaft.

8. A microwave switch as claimed in claim 1 or 2 characterized by an electronic control circuit having a timer function for supplying a switch current of reversible current direction to said driving coil, said tier function being arranged to maintain the switch current during an elapse of time which is longer than the time of movement of the switch rotor between said switch positions.

9. A microwave switch as claimed in claim 1 or 2, said electromagnetic driving device being provided on the top of a roof-wall of the switch housing and having its pole shoes resting against the roof-wall and leveled with said permanent magnetic rotor part being formed by a circular rotor disc, said magnetic yoke and said pole shoes being manufactured in one unit from a homogeneous, soft-magnetic sheet metal of a uniform thickness, characterized by said pole shoes being formed by two parallel, elongated elements in the plane of said roof-wall, the inner long sides in the direction of said shaft being provided with opposite, circle-segment shaped recesses adjoining and partly enclosing said rotor disc, and said magnetic yoke being shaped as an upside down U, the base of which is formed by a coil carrying element arranged transverse to said pole shoe elements and substantially in a plane which is parallel therewith and the legs of which are formed by angularly bent leg elements, being each connected via an angular bend to a corresponding pole shoe element at one end of its external long side, said leg elements having a length which is such that a space is formed for the winding of the driving coil.

10. A microwave switch as claimed in claim 1 or 2, characterized by the common shaft of the switch rotor and the rotor part of the electromagnetic driving device being provided with an extension adjoining the rotor part, said extension forming a grip at the level of the upper part of the driving coil for manually switching the switch rotor.

* * * * *

UNITED STATES PATENT AND TRADEMARK OFFICE

CERTIFICATE OF CORRECTION

PATENT NO. : 5,748,055
DATED : May 5, 1998
INVENTOR(S) : Göran Ors

It is certified that error appears in the above-indentified patent and that said Letters Patent is hereby corrected as shown below:

On the title page,

[54] Title, delete the title "MICROWAVE SWITCH" and insert therefor -- ROTARY WAVEGUIDE SWITCH --.

Abstract, line 12, replace "poles" with -- pole --.
Column 1, line 10, replace "comprises" with --comprise --.
Column 1, line 60, replace "one" with -- on --.
Column 1, line 66, replace "nextcoming" with -- next coming --.
Column 3, line 52, replace "poles" with -- pole --.
Column 3, line 52, before "11, 12" insert -- shoes --.
Column 5, line 31, replace "recesses 17,19" with -- recesses 17,18 --.
Column 5, line 35, replace "poles shoes"with -- pole shoes --.
Column 5, line 58, replace "hoes" with -- holes --.
Column 6, line 31, before "housing" insert -- switch --.
Column 6, lines 38, 39, replace "poles shoes" with -- pole shoes --.
Column 7, line 24, replace "tier" with -- timer --.

Signed and Sealed this

Twenty-fifth Day of May, 1999

*Attest:*

Q. TODD DICKINSON

*Attesting Officer*

*Acting Commissioner of Patents and Trademarks*